US006386289B1

(12) United States Patent
Patel

(10) Patent No.: US 6,386,289 B1
(45) Date of Patent: May 14, 2002

(54) RECLOSABLE CIRCULATING VALVE FOR WELL COMPLETION SYSTEMS

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/248,457

(22) Filed: Feb. 11, 1999

Related U.S. Application Data

(60) Provisional application No. 60/074,493, filed on Feb. 12, 1998.

(51) Int. Cl.[7] ..... E21B 34/14

(52) U.S. Cl. ..... 166/325; 166/317; 166/321; 166/323; 166/224

(58) Field of Search ..... 166/317, 321, 166/323, 324, 334.4, 177.5, 331, 373, 374, 325

(56) References Cited

U.S. PATENT DOCUMENTS 3,970,147 A * 7/1976 Jessup et al. ..... 166/374
4,427,070 A 1/1984 O'Brien
4,452,313 A * 6/1984 McMahon ..... 166/317 X
4,911,242 A 3/1990 Hromas et al.
4,979,569 A 12/1990 Anyan et al.
5,170,844 A 12/1992 George et al.
5,341,883 A * 8/1994 Ringgenberg ..... 166/324

* cited by examiner

*Primary Examiner*—David Bagnell
*Assistant Examiner*—Kamal Dawekbeit
(74) *Attorney, Agent, or Firm*—Trop, Pruner & Hu P.C.

(57) ABSTRACT

A valve for use in a tool positioned in a well that includes a body having a bore and a port connected to permit fluid communication between the well and the bore. A piston is supported in the body for movement between an open position to open the port and a closed position to close the port. A rupture disc is responsive to fluid pressure in the well and ruptures when a predetermined pressure is applied so that fluid pressure is communicated to the piston to move it from the closed position to the open position. A lock member secures the piston in the closed position after the piston moves from the open position to the closed position.

21 Claims, 4 Drawing Sheets

RECLOSABLE CIRCULATING VALVE FOR WELL COMPLETION SYSTEMS

This claims the benefit under 35 U.S.C. § 119(e) to U.S. Provisional Application Ser. No. 60/074,493, entitled "Reclosable Circulating Valve for Well Completion Systems," filed Feb. 12, 1998.

BACKGROUND OF THE INVENTION

In the completion of wells drilled into subterranean formations, a casing string is normally run into the well and cemented to the wall of the well. Then perforating guns are used to create perforation tunnels through the casing. The perforation tunnels are created adjacent the formation at pay zones to allow fluids, such as oil or gas, to flow from the formation into the well.

During the well completion phase, a fracture operation may be used to increase the permeability of the formation. A fracture operation typically involves lowering a work string to a point adjacent the formation to be fractured, i.e. near the perforation tunnels. Then fracturing fluid is pumped out of the lower end of the work string and into the perforation tunnels at a pressure sufficient to cause the bedding planes of the formation to separate. This separation of the bedding planes creates a network of permeable fractures through which formation fluid can flow into the well after completion of the fracture operation.

The fractures have a tendency to close once the fracture pressure is relaxed. Thus, proppants (e.g. sand, gravel, or other particulate material) are routinely mixed with the fracturing fluid to form a slurry which carries the proppants into the fractures where they remain to prop the fractures open when the pressure is reduced. A condition referred to as screen-out may occur when a portion of the proppants comes out of the perforation tunnels and fills up the annular space between the casing and the work string. Screen-out can occur more than once during a fracture operation.

Whenever screen-out occurs or after the fracture operation is completed, it is necessary to circulate the fracturing fluid out of the work string. Typically, a mechanical valve with multiple open/close capability is required to permit circulation of the fracturing fluid out of the work string.

SUMMARY OF THE INVENTION

In general, in one aspect, the invention features a valve for use in a tool positioned in a well that includes a body having a bore and a port connected to permit fluid communication between the well and the bore. A piston is supported in the body for movement between an open position to open the port and a closed position to close the port. A rupture disc is responsive to fluid pressure in the well and ruptures when a predetermined pressure is applied so that fluid pressure is communicated to the piston to move it from the closed position to the open position. A lock member secures the piston in the closed position after the piston moves from the open position to the closed position.

Other features will become apparent from the following claims.

DESCRIPTION OF THE PREFERRED EMBODIMENTS

Figure 1:
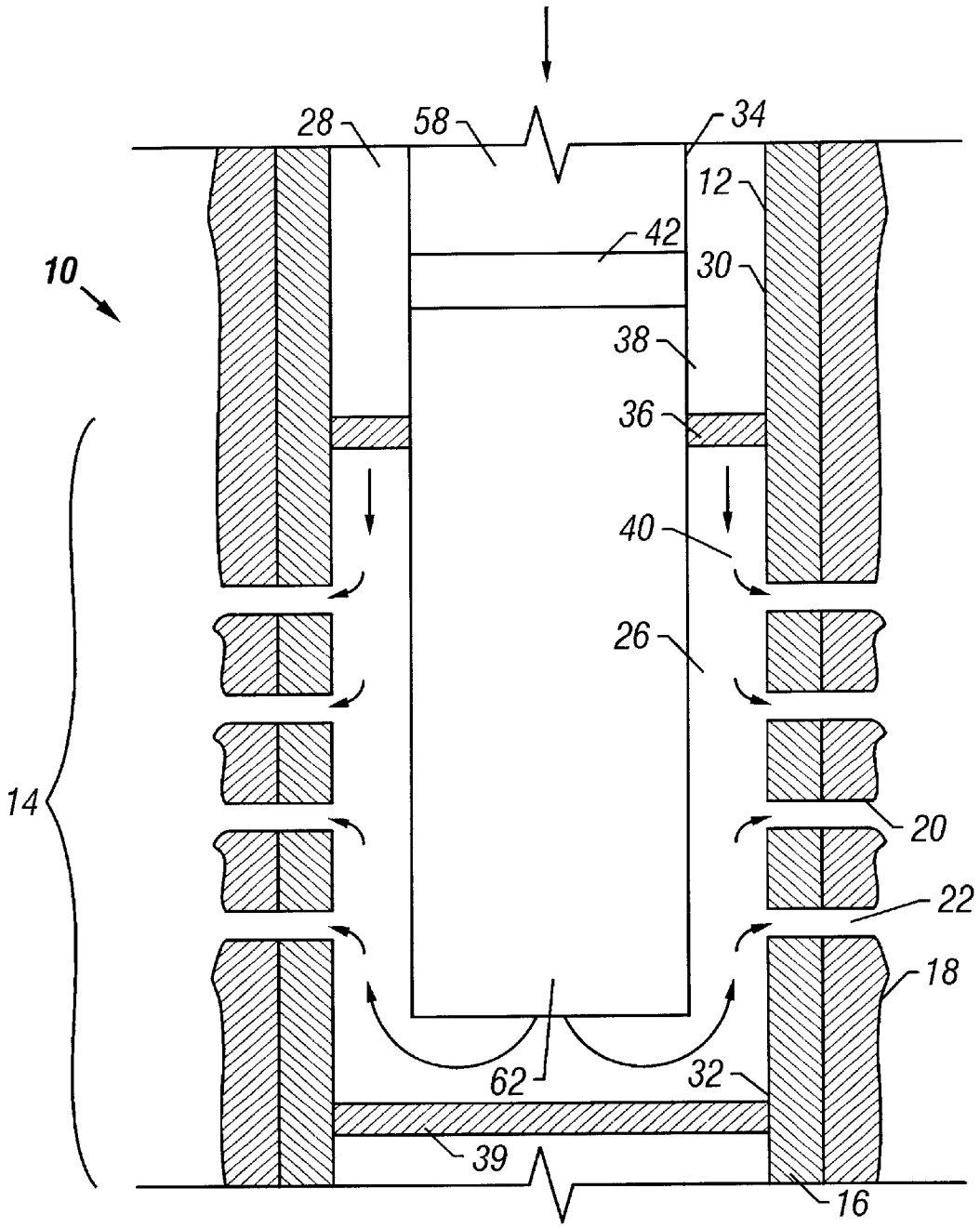
FIG. 1 is a schematic of a well completion system in which an embodiment of the invention is used.

Referring to the drawings wherein like characters are used for like parts throughout the several views, FIG. 1 depicts a well completion system 10 which includes a wellbore 12 extending from the surface (not shown) through a fracture zone 14. Lining the wellbore 12 is casing 16 which is held in place by a cement sheath 18. The casing 16 and the cement sheath 18 are provided with a plurality of perforations 20 which are aligned to define perforation channels 22 through which fluids may flow into or out of the formation adjacent to the wellbore 12. While the wellbore 12 is shown as a cased, vertical wellbore, it should be clear that the invention is equally applicable in open, underreamed, horizontal, and inclined wellbores.

A downhole tool 26 positioned in the wellbore 12 includes a tubing string 28 which extends from the surface (not shown) to the fracture zone 14. The tubing string 28 is concentrically received in the wellbore 12 such that an annular passage 30 is defined between the inner wall 32 of the casing 16 and the outer wall 34 of the tubing string 28. Packers 36, 39 are set in the annular passage 30 to isolate the section of the wellbore 12 which lies adjacent the fracture zone 14. Packer 36 divides the annular passage 30 into an upper annular passage 38 and a lower annular passage 40. The downhole tool 26 includes a circulation valve 42 which may be actuated to permit fluid communication between the inside of the tubing string 28 and the upper annular passage 38.

The tubing string 28 can be divided in two segments, with an upper segment 58 connected to the upper end of the circulating valve 42 and the bottom segment 62 connected to the lower end of the valve 42.

In operation, fracturing fluid with proppants is pumped down the bore of the tubing string 28. The circulation valve 42 is maintained in the closed position so that the fracturing fluid pumped down the bore of the tubing string 28 exits the lower end of the tubing string and rises up the lower annular passage 40. As the lower annular passage 40 fills with the fracturing fluid, the fracturing fluid is forced into the perforation channels 22 to initiate fractures in the formation. As more fluid is pumped down the bore of the tubing string 28, the fractures are enlarged.

Eventually a point of screen-out is reached at which a portion of the proppants come out of the perforation channels and fills the lower annular passage 40 surrounding the bottom segment 62 of the tubing string 28. When screen-out occurs, pumping more fracturing fluid will only further exert pressure on the formation. Proppants will also build up in the tubing string 28.

When screen-out occurs, the proppants can be removed by circulating the fracturing fluid out of the tubing string 28. To accomplish this, fluid is pumped from the surface through the upper annular passage 38 between the casing 16 and tubing string 28. When the flow reaches a predetermined pressure, the circulation valve 42 opens to allow the fluid in the upper annular passage to flow into the tubing string 28. The fluid flowing into the tubing string 28 then pushes the fracturing fluid (along with the proppants) up the tubing string 28 to the surface. The same operation can also be performed in conditions other than screen-out, such as after completion of the well.

Figure 2A:
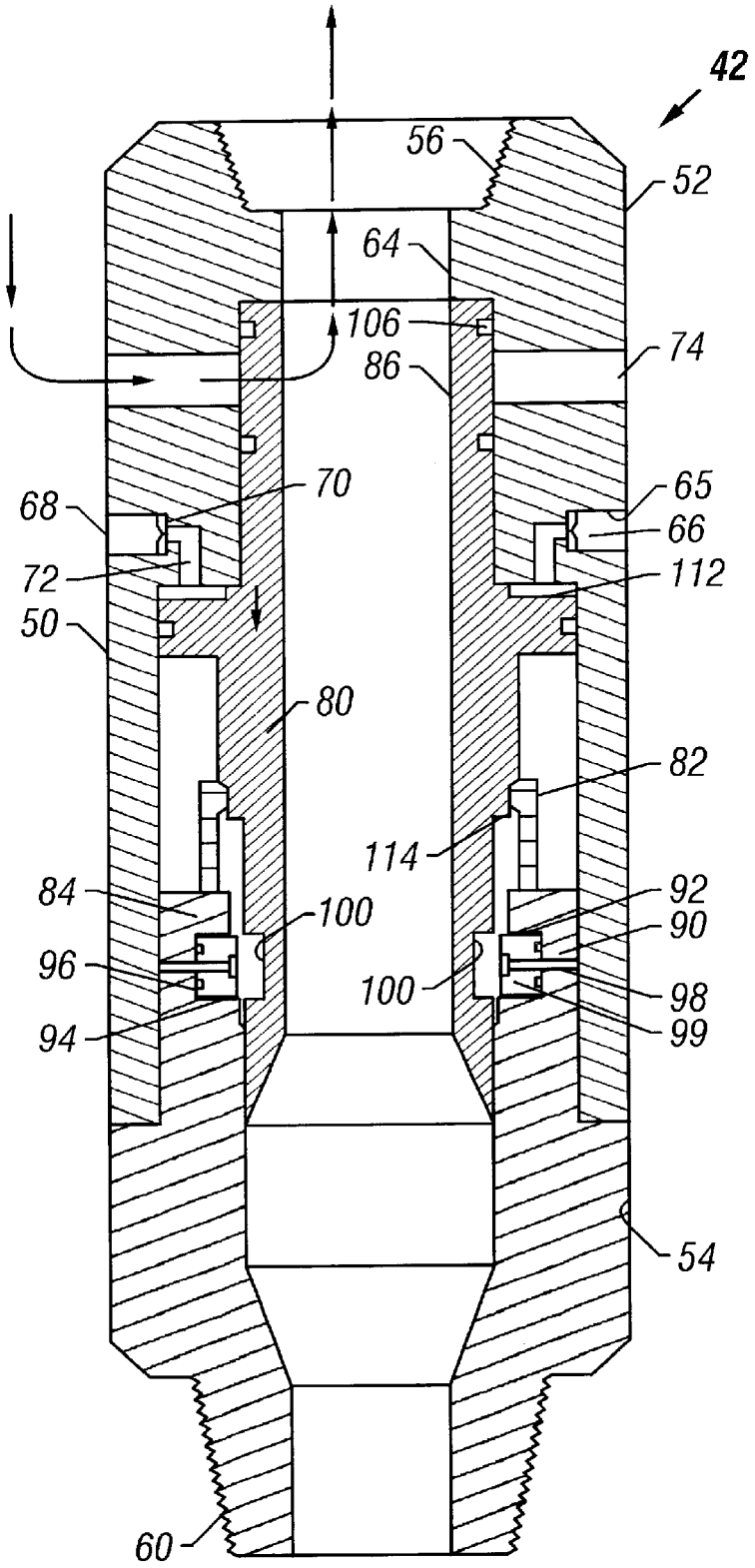
FIGS. 2A–2B are vertical cross-sectional views of a circulating valve in respective first and second positions according to an embodiment of the invention.
Figure 2B:
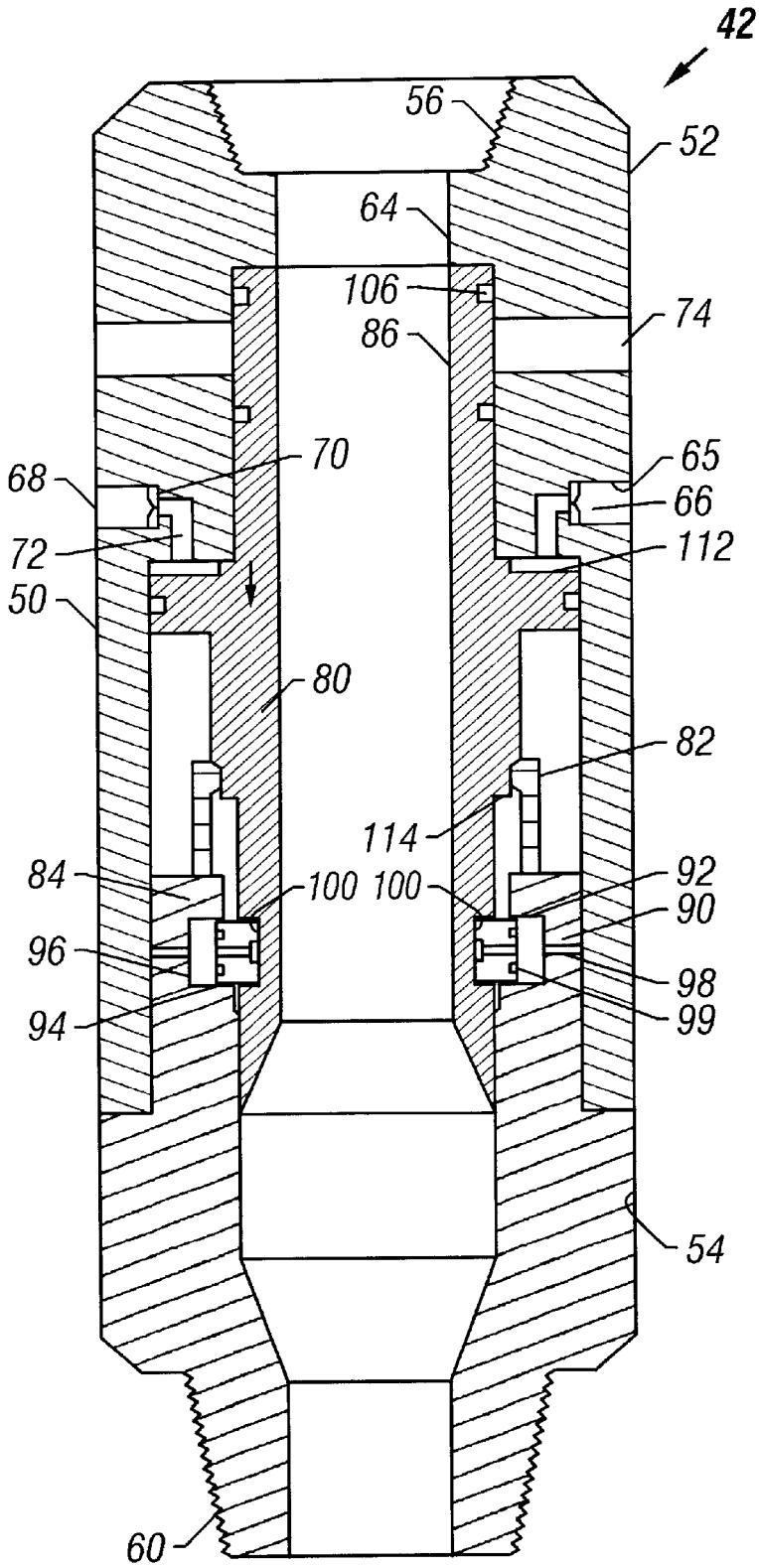
Figure 3:
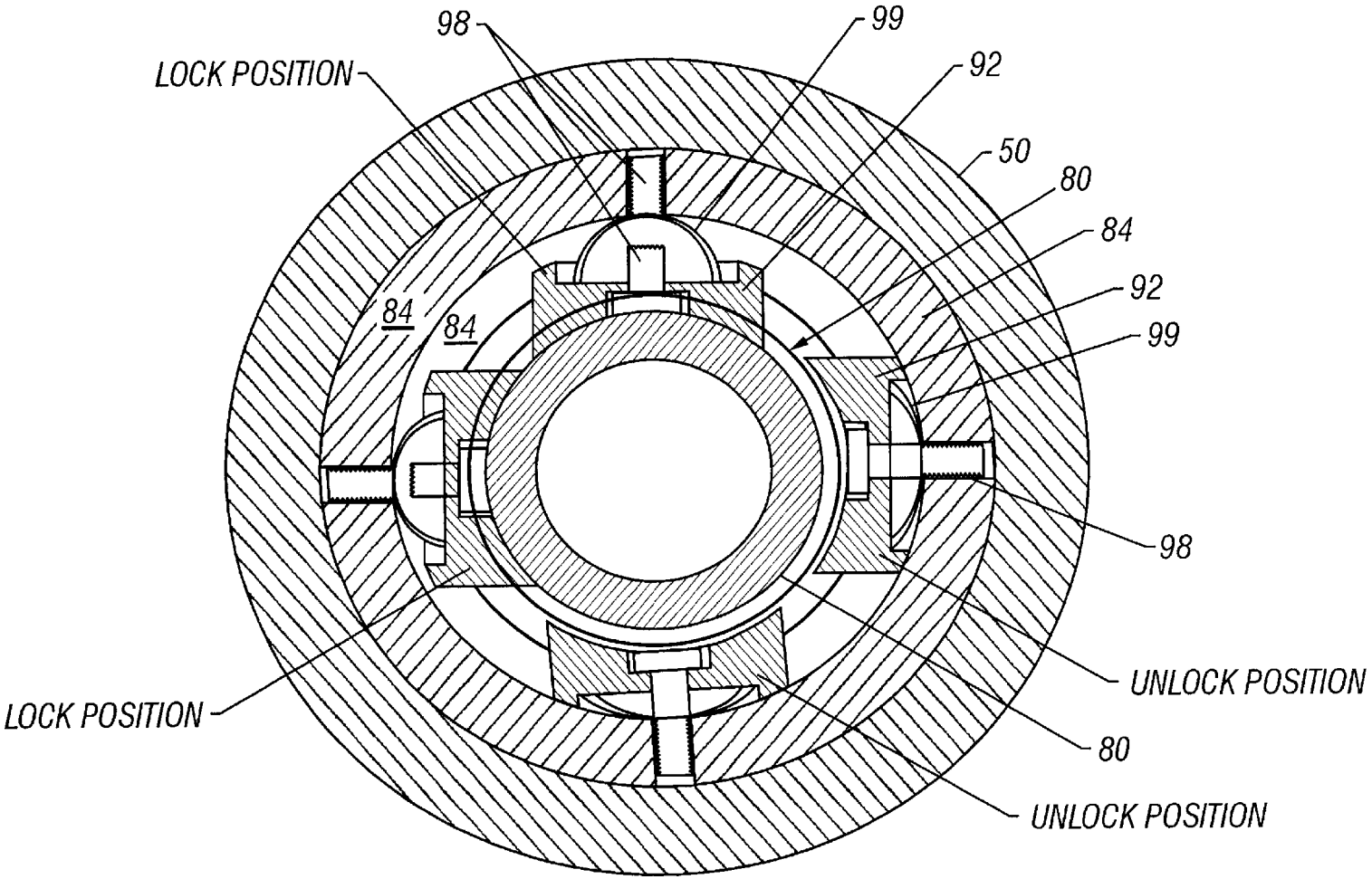
FIG.3 is a horizontal cross-section view of a portion of the circulation valve.

Referring to FIGS. 2A–2B, and 3 the circulating valve 42 includes a housing body 50 having a top portion 52 which is threadably connected to a bottom portion 54. The upper end of the top portion 52 includes a threaded receptacle 56 for connecting to the upper segment 58 of the tubing string 28 (shown in FIG. 1). The lower end of the bottom portion 54 includes a threaded stub 60 for connecting to the lower segment 62 of the tubing string 28 (shown in FIG. 1). The housing body 50 is provided with a throughbore 64 which permits fluid communication between the upper segment 58 and the lower segment 62 of the tubing string 28.

In the top portion 52 of the housing body 50 is a pocket 65 in which a rupture disc 66 is mounted. The rupture disc 66 is exposed to the casing pressure, i.e., the pressure in the upper annular passage 38, through a port 68 at the outer edge of the pocket 65. The inner edge 70 of the pocket 65 is connected to a port 72 which opens to the interior of the housing body 50. The top portion 52 of the housing body 50 also includes circulating ports 74 which may communicate with the throughbore 64.

A mandrel 80 disposed inside the housing body 50 is held in place in the housing body by a collet 82 which is mounted on a collar ring 84 in the bottom portion 54 of the housing body 50. The mandrel 80 can be movable up and down by fluid pressure relative to the housing body 50. The mandrel 80 includes a bore 86 which is coincident with the throughbore 64 of the housing body 50. In its up position as shown, the mandrel 80 closes the circulating ports 74 such that fluid communication between the upper annular passage 38 and the throughbore 64 is prevented. Sealing rings 106 are seated in slots in the mandrel 80 to seal the circulating port 74.

A mandrel lock 90 that includes radial segments 92 is engageable in a groove 94, as shown in FIG. 2B in the bottom portion 54 of the housing body 50. The radial segments 92 are held in place against the end wall 96 of the groove 94 by screws 98. The mandrel lock 90 also includes garter springs 99 which are arranged to force the lock 90 radially inward to engage the mandrel 80 when the screws 98 are sheared. Once the screws are sheared, the lock 90 can snap into a locking groove 100 in the mandrel 80 to permanently maintain the mandrel 80 in a closed position, i.e. a position where the mandrel 80 covers the circulating ports 74.

The rupture disc 66 prevents casing pressure from acting on the mandrel 80 until the disc 66 is burst by applying a predetermined pressure on the casing. When the rupture disc 66 bursts, casing pressure is communicated to the pressure surface 112 through the port 72. The casing pressure acts on the pressure surface 112 to push the mandrel 80 downwardly until a shoulder 114 on the mandrel 80 lands on the mandrel lock 90 and shears the screws 98. When the mandrel 80 moves downwardly, the circulating ports 74 are uncovered to permit fluid to flow into the throughbore 64 and up the tubing string 28.

In operation, the circulating ports 74 are initially closed by the mandrel 80, which is in its up position. Fluid pumped into the tubing string 28 from the surface passes through the bore 86 of the mandrel to the lower segment 62 of the tubing string where it exits into the lower annular passage 40. When it is desired to move a fluid mixture out of the tubing string 28, fluid is pumped down the upper annular passage 38. The rupture disc 66 is exposed to the fluid pressure in the upper annular passage 38. The rupture disc 66 bursts when the fluid pressure in the upper annular passage 38 reaches a predetermined rupture pressure.

When the rupture disc 66 bursts, fluid flows into the port 72 to the pressure surface 112 of the mandrel 80 to apply pressure on the mandrel 80. The fluid pressure acts on the mandrel 80 and moves the mandrel 80 down to uncover the circulating ports 74. At the end of the downward stroke of the mandrel 80, the mandrel shoulder 114 hits the lock segments 92 and, if sufficient force is applied, the screws 98 holding the segments 92 in the groove 94 are sheared. Once the screws 98 are sheared, the garter springs 99 move the lock 90 radially inward until the lock segments 92 are resting on the outer wall of the mandrel 80.

To close the circulating ports 74, a pressure differential between the inside of the tubing string 28 and the casing 16 is required to move the mandrel 80 up. This is achieved by pumping fluid at high rate into the tubing string 28. The fluid pumped into the tubing string 28 exits through the circulating ports 74 into the upper annular passage 38. The pressure loss across the circulating ports 74 creates the pressure differential required to move the mandrel up to close the circulating ports 74. At the end of the upward stroke of the mandrel 80, the lock segments 92 snap into the locking groove 100 and lock the mandrel 80 permanently in the closed position.

The fluid rate of the circulating ports 74 can be controlled by varying the diameter of the ports. A lower flow rate results in a lower pressure applied on the mandrel.

The opening of the valve does not depend on pressure differential and the rupture disc is exposed to absolute casing pressure. Therefore, accurate knowledge of fluid density or pressure at the valve is not critical. The inner wall of the mandrel can be made smooth to minimize susceptibility to erosion during very high rate large volume fracturing operations.

In an operation where it is desired to fracture multiple zones or where a valve with multiple open/close capability is required, multiple circulating valves may be used to circulate fluid out of the tubing string. The valves may be arranged in the upper section of the tubing string above the packer. The rupture disc of the different valves can be pre-set to burst at different casing pressures.

Although the circulation valve has been described with respect to fracturing operation during well completion, it should be clear that the circulation valve may be used in any downhole application where it is desired to recirculate fluid out of a flow conduit concentrically received in a wellbore. For instance the circulation valve may be used during a well clean-up operation or with a fracture/gravel-packing operation.

While the present invention has been described with respect to a limited number of embodiments, those skilled in the art will appreciate numerous modifications and variations therefrom. The appended claims are intended to cover all such modifications and variations which occur to one of ordinary skill in the art.

What is claimed is:

1. A valve for use in a tool positioned in a well, comprising:

a body having a bore and a port connected to permit fluid communication between the well and the bore;

a piston supported in the body for movement between an open position to open the port and a closed position to close the port;

a rupture disc responsive to fluid pressure in the well, the rupture disc to rupture when a predetermined pressure is applied so that fluid pressure is communicated to the piston to move it from the closed position to the open position; and a lock member for securing the piston in the closed position after the piston moves from the open position to the closed position, wherein the lock member is attached to the body by a releasable member, the releasable member to release the lock member when sufficient pressure is applied.

2. The valve of claim 1, wherein the releasable member comprises a shearable member, wherein the shearable member is sheared when sufficient pressure is applied to the piston.

3. The valve of claim 2, wherein the shearable member includes a screw.

4. The valve of claim 2, wherein the lock member is seated in a groove in the valve body.

5. The valve of claim 2, wherein the lock member includes a spring that forces it radially inward once the shearable member is sheared.

6. The valve of claim 5, wherein the piston includes an outer surface, and wherein the lock member is forced against the outer surface of the piston by the spring.

7. The valve of claim 6, wherein the piston includes a locking groove in its outer surface, and wherein the lock member is pushed into the locking groove when the piston moves from its open position to its closed position.

8. The valve of claim 7, comprising only one rupture disc.

9. The valve of claim 1, wherein the body includes multiple ports.

10. The valve of claim 1, wherein the piston is moved from its open position to its closed position by pumping fluid through the bore and the port.

11. A valve for circulating fluid out of a downhole tool concentrically received in a wellbore, comprising:

an elongated body having a bore therein and a circumferential groove on an outer surface, the body having a plurality of ports radially spaced along a circumference of the body, the ports being configured to permit selective communication between the wellbore and the bore;

a piston supported in the body for movement between an open position to open the ports and a closed position to close the ports, the piston being provided with a bore coincident with the bore of the elongated body, the bore of the piston being configured to permit fluid communication between the conduit and the wellbore;

a rupture disc for controlling the pressure acting to move the piston from an initial closed position to the open position; and a lock member for securing the piston to the body after the piston moves from the open position to the closed position, wherein the lock member includes a plurality of radial segments.

12. The valve of claim 11, wherein the lock member is disposed in a pocket inside the elongated body.

13. The valve of claim 11, wherein the lock member includes springs for moving the radial segment to engage an outer wall of the piston.

14. The valve of claim 13, wherein the piston is provided with a locking groove, the locking groove being configured to receive the radial segments, thereby locking the piston in a closed position.

15. The valve of claim 11, wherein the body includes a port connecting the rupture disc to a surface of the piston.

16. A well tool for fracturing subterranean formation adjacent a wellbore, comprising:

a tubing having a bore through which fluid may be communicated; and a valve disposed in the tubing above the packer, including:

a body having a bore and a port connected to permit fluid communication between a well annular space and the bore;

a piston adapted to move between an open position to open the port and a closed position to close the port;

a ruptured disc responsive to fluid pressure in the well annular space, wherein the rupture disc ruptures when a predetermined pressure is applied so that fluid pressure is communicated from the well annular space to the piston to move it from the closed position to the open position; and a lock member for securing the piston in the closed position after the piston moves from the open position to the closed position.

17. A downhole tool for use in a wellbore, comprising:

a conduit;

a valve connected to the conduit and comprising:

a body having a bore and a port adapted to permit fluid communication between a well annulus region and the bore;

a mandrel adapted to move between an open position to open the port and a closed position to close the port;

a rupture member adapted to block communication of fluid pressure to the mandrel, the rupture member capable of being ruptured to enable communication between the well annulus region and the mandrel; and a lock member adapted to be actuated to lock the mandrel in the closed position after the mandrel moves from the open to the closed position.

18. The downhole tool of claim 17, wherein the lock member is actuated in response to movement of the mandrel from a closed position to an open position.

19. The downhole tool of claim 17, wherein the valve comprises a circulation valve.

20. The downhole tool of claim 17, wherein the body further comprises at least another port.

21. A valve for use in a tool positioned in a well, comprising:

a body having a bore and a port connected to permit fluid communication between the well and the bore;

a piston supported in the body for movement between an open position to open the port and a closed position to close the port;

a rupture disc responsive to fluid pressure in the well, the rupture disc to rupture when a predetermined pressure is applied so that fluid pressure is communicated to the piston to move it from the closed position to the open position; and a lock member for securing the piston in the closed position after the piston moves from the open position to the closed position, wherein the lock member is attached to the body by a shearable member, the shearable member being sheared when sufficient pressure is applied to the piston.

* * * * *